United States Patent [19]

Walter et al.

[11] Patent Number: 5,004,437

[45] Date of Patent: Apr. 2, 1991

[54] ELECTRICAL CONNECTOR BLOCKS

[75] Inventors: Gerard S. Walter, Glenshaw; John Hagan, Gibsonia, both of Pa.

[73] Assignee: Walter Electrical Manufacturing Company, Pittsburgh, Pa.

[21] Appl. No.: 28,200

[22] Filed: Mar. 20, 1987

Related U.S. Application Data

[63] Continuation of Ser. No. 734,481, May 16, 1985, abandoned, which is a continuation-in-part of Ser. No. 691,502, Jan. 14, 1985, Pat. No. 4,640,571.

[51] Int. Cl.[5] ..... H01R 4/36

[52] U.S. Cl. ..... 439/811; 439/782; 439/791

[58] Field of Search ..... 339/272, 242, 243, 244, 339/248, 263 R, 198

[56] References Cited

U.S. PATENT DOCUMENTS

| | | | |
|---|---|---|---|
| 1,991,075 | 2/1935 | Bloomquist | 173/273 |
| 2,551,636 | 5/1951 | Ratigan | 24/262 |
| 2,907,977 | 10/1959 | Daley | 339/272 |
| 3,018,464 | 1/1962 | Mrenna et al. | 339/198 |
| 3,181,106 | 4/1965 | Fielder | 339/95 |
| 3,339,174 | 8/1967 | Walter et al. | 339/272 R |
| 3,829,825 | 8/1974 | Hawkins | 339/242 |

*Primary Examiner*—David L. Pirlot

*Attorney, Agent, or Firm*—Buchanan Ingersoll; Michael L. Dever

[57] ABSTRACT

An electrical connector block is provided having a housing with a pair of generally parallel sidewalls extending from a base member and separated by a trough open on the side opposite the base member, a groove on each sidewall opposite the trough and spaced from the open side of the trough, a cap member having depending arms adapted to slide along the sides of the parallel sidewalls over the open trough, said arms having inturned flanges engaged in the grooves of the sidewall, at least one screw member threadingly engaged in said cap member and carrying a clamp member pivoted on the end thereof between the sidewalls for clamping a wire between the clamp member and base member.

1 Claim, 1 Drawing Sheet

ELECTRICAL CONNECTOR BLOCKS

This application is a continuation of our copending application Ser. No. 734,481, filed May 16, 1985 now abandoned, which as a continuation-in-part of application Ser. No. 691,502, filed Jan. 14, 1985 U.S. Pat. No. 4,640,571.

The present invention relates to electrical connector blocks and particularly to a modular form of connector block which may be used to couple various sizes of cables together in various multiples and in which the modules may take different sizes and be connected together to form a single integral unit.

In the past it has been the practice to connect heavy conductors together or to a busbar using wire clamps with a screw type clamp to apply connecting pressure to the conductor. Typical of such prior art connectors are those illustrated in U.S. Pat. Nos. 1,913,552; 2,232,602; 2,288,941; 2,290,691; 2,569,223; 3,047,835; 3,335,399, earlier Walter U.S. Pat. Nos. 3,425,022 and 3,551,876 and in French Pat. No. 888,909; British Pat. No. 692,707 and German Pat. No. 736,704. Those earlier patents, while excellent for their time and purpose were limited in number and variety of wire connections that they could be used to make.

We have invented a connector structure which can connect a plurality of wires in a single module and the number and variety of sizes of wires which may be connected together to form a single connection is quite large.

We provide an electrical connector comprising a generally U-shaped housing having a pair of generally parallel elongate sidewalls separated by a trough open on the side opposite the bottom of the U-shaped housing, a groove on each side wall opposite the trough and equally spaced from the open side of the trough, a cap means having depending arms adapted to slide along the sides of the parallel sidewalls over the open trough and having internal flanges engaged in the grooves in the sidewall, at least one first screw member threadingly engaged in a first portion of said cap means and at least one second screw member threadingly engaged in a second portion of said cap means, each of said first and second screw members carrying a clamp member pivoted therein for clamping a wire between said clamp member and the bottom of the U-shaped housing. Preferably, the U-shaped housing has a cylindrical surface at the bottom of the trough and the clamp member has a like surface whereby a generally cylindrical wire can be clamped therebetween. Preferably, interchangeable cap members are provided having either one or three clamping members. The cap member having three clamp members is preferably provided with a pair of depending members between its depending arms on opposite sides of the sidewalls from said arms forming a central channel between them, each central member has an inturned flange toward the other forming a supporting trackway carrying an enlarged end on the stem of a generally T-shaped member movable in the channel toward and away from the base and a pair of screw members in the cap member on opposite sides of the T member, each carrying a clamp member pivoted thereon adapted to clamp a wire between it and a clamp surface on the head of the T and to exert pressure thereon to move the head of the T to clamp a larger wire between it and the bottom of the trough so as to form a three wire clamp. Preferably the housing is provided with two cap members, one at each end with the desired clamping members thereon for clamping the selected array of wires, all in conductive relation.

In the foregong general description of our invention we have set out certain objects, purposes and advantages to be achieved thereby. Other objects, purposes and advantages of the invention will be apparent from a consideration of the following description and the accompanying drawings in which.

Figure 1:
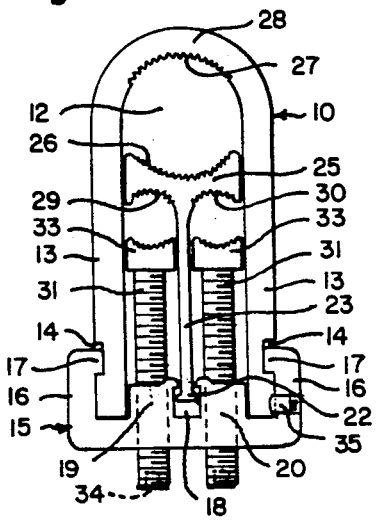
FIG. 1 is an end elevational view of a conductor block of this invention.
Figure 4:
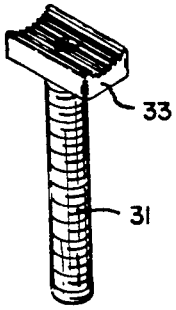
Figure 5:
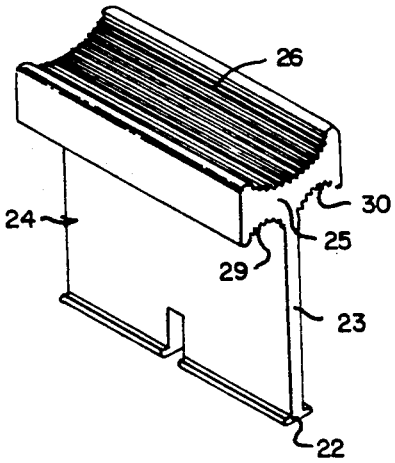
Figure 2:
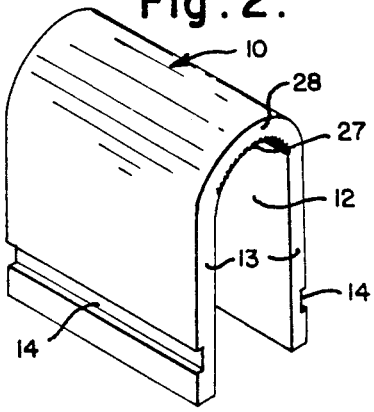
FIG. 2 is an isometric view of the housing of the conductor block of FIG. 1.
Figure 3:
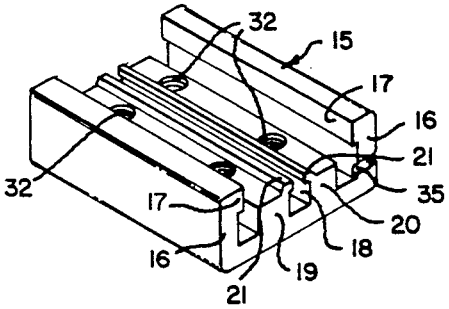
FIG. 3 is an isometric bottom view of the cap member shown in FIG. 1.
Figure 6:
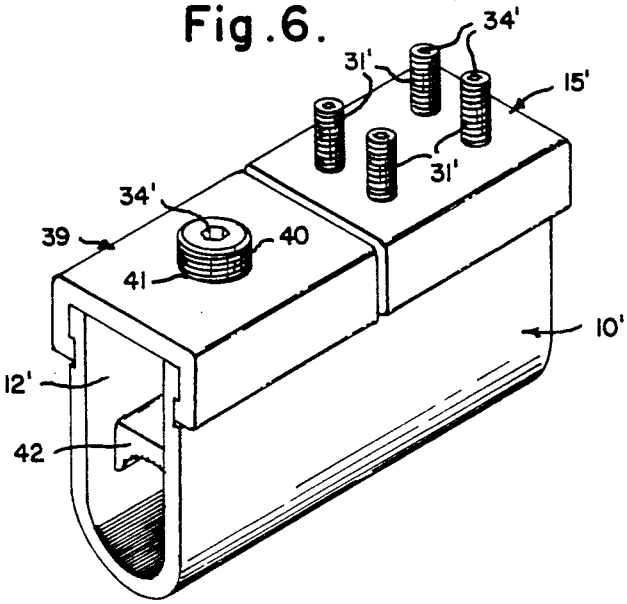
Figure 7:
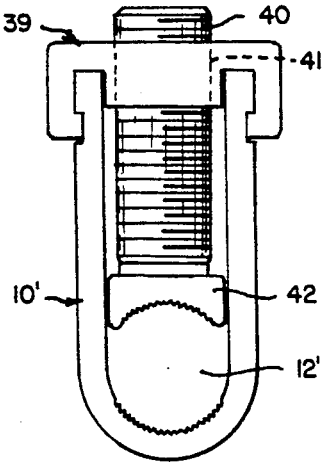

FIG. 4. is an isometric view of the T-clamp member of FIG. 1 for use in a three wire connection;

FIG. 5 is an isometric view of a screw clamp according to the invention;

FIG. 6 is an isometric view of a second embodiment of the invention with a single wire clamp at one end and a triple wire clamp as in FIG. 1 at the other end; and FIG. 7 is an end view from the left of FIG. 6.

Referring to the drawings, we have illustrated in FIGS. 1 through 5 a U-shaped housing 10 forming a trough 12 between generally parallel sidewalls 13. Each sidewall has a groove 14 adjacent the end remote from the bottom of trough 12 extending the length of the sidewall. A cap means here represented by cap member 15 having depending arms 16 slidable along the top and outside of the sidewalls over grooves 14 is fitted on each clamp. Each depending arm 16 has an inturned flange 17 engaging in groove 14 to hold the cap member on the sidewalls. In a triple wire clamp arrangement as illustrated in FIGS. 1-5, the cap member 15 may have a central channel 18 formed between two depending members 19 and 20 each having an inturned flange 21 forming a supporting trackway for an enlarged end 22 on the stem 23 of T-shaped member 24, having a head 25 spaced from the bottom of the trough 12. Head 25 has a curved surface 26 facing the curved surface 27 of the trough bottom 28 and on generally the same radius. On the opposite side, head 25 has two curved surfaces 29 and 30. Screw members 31 are threaded in holes 32 in cap member 15 on opposite sides of channel 18. Each screw member is fitted at one end with a pivoted clamp member 33, slidable between stem 23 and sidewalls 13. The other end has a drive connection such as hexagonal hole 34. Preferably at least one of the sidewalls is provided with a stop detent 35 along one top edge to limit movement of cap member 15.

In FIG. 6 we have illustrated another embodiment in which like parts of FIGS. 1-5 have like numbers with a prime sign. In this embodiment a cap member 15' identical to that of FIGS. 1-5 is used at one end of housing 10'. At the other end a cap member 39 is provided with single screw member 40 threaded in hole 41. The screw member 40 is provided with a clamp member 42 pivoted on the end thereof within trough 12' and a drive connection such as hexagonal hole 34' for an Allen wrench at the other end, outside the clamp.

As can be seen from FIGS. 1 through 6, the clamp of this invention may take various sizes and assembly configurations for connecting different size wires.

In the foregoing specification we have set out certain preferred practices and embodiments of our invention, however, it will be understood that this invention may be otherwise embodied within the scope of the following claims.

We claim:

1. An electrical connector block comprising a generally U-shaped housing having a pair of generally parallel elongate sidewalls separated by a trough open on the side opposite the bottom of the U-shaped housing, a groove on each sidewall opposite the trough and spaced from the open side of the trough, at least two cap means having depending arms adapted to slide along the sides of the parallel sidewall over the open trough, said arms having inturned flanges engaged in the grooves of the sidewall, at least one screw member threadingly engaged in each said cap means, each of said screw members carrying a separate clamp member pivoted on the end thereof and independently movable between the sidewalls for clamping at least one wire between each clamp member and a portion of the trough, wherein at least one of said cap means is provided with a pair of depending members between the sidewalls forming a channel intermediate the sidewalls, an inturned flange on each depending member extending partially across the channel to form a trackway, an inverted T-shaped member having an enlarged end on the stem thereof adapted to be supported on said trackway and move vertically in the channel so that the head of the T can move toward and away from the bottom of the U-shaped member, a pair of screw members in the cap means adjacent each of said depending members, a pivotal clamp member on the end of each screw member between a sidewall and the stem of the T member, a clamping surface on the T head facing the bottom of the trough and a clamp surface on the opposite side of the T head between the stem and sidewall whereby a large wire may be clamped between the T head and bottom of the trough and two smaller wires between the clamp member on the screw members and the clamp surfaces on the opposite side of the T head.

* * * * *